US009333617B2

(12) United States Patent
Whipple

(10) Patent No.: US 9,333,617 B2
(45) Date of Patent: May 10, 2016

(54) DECONTAMINATION DEVICE AND METHOD FOR REMOVING CONTAMINANTS FROM ELECTRICAL APPARATUS

(71) Applicant: EATON CORPORATION, Cleveland, OH (US)

(72) Inventor: Michael Jerome Whipple, Rochester, PA (US)

(73) Assignee: EATON CORPORATION, Cleveland, OH (US)

( * ) Notice: Subject to any disclaimer, the term of this patent is extended or adjusted under 35 U.S.C. 154(b) by 301 days.

(21) Appl. No.: 14/013,263

(22) Filed: Aug. 29, 2013

(65) Prior Publication Data

US 2015/0065016 A1 Mar. 5, 2015

(51) Int. Cl.
*B24D 15/04* (2006.01)
*B24B 27/033* (2006.01)

(52) U.S. Cl.
CPC ..... *B24B 27/033* (2013.01); *B24D 15/04* (2013.01)

(58) Field of Classification Search
CPC ..... B21B 45/04; B24B 27/033; B24D 15/02; B24D 15/04; H01H 1/60; H01H 1/18; Y10T 29/4561; B25B 5/166; B25B 11/02; Y10S 269/903; Y10S 269/909
USPC ..... 200/242, 253; 29/81.11; 451/59, 103, 451/525, 524; 30/169–172; 361/627, 628, 361/631, 636, 637, 639, 640, 648, 656
See application file for complete search history.

(56) References Cited

U.S. PATENT DOCUMENTS

| | | | | | |
|---|---|---|---|---|---|
| 2,471,236 | A * | 5/1949 | Parker | 451/558 |
| 2,910,629 | A * | 10/1959 | Casey | 361/635 |
| 2,914,708 | A * | 11/1959 | Edmunds | 361/634 |
| 3,080,594 | A * | 3/1963 | Race | 15/210.1 |
| 3,218,520 | A * | 11/1965 | Casey | 361/654 |
| 3,263,132 | A * | 7/1966 | Bangert, Jr. | 361/635 |
| 3,287,607 | A * | 11/1966 | Jacobs et al. | 361/634 |
| 3,309,580 | A * | 3/1967 | Jacobs et al. | 361/635 |
| 3,343,245 | A * | 9/1967 | Sylvester | 407/29.11 |
| 3,383,486 | A * | 5/1968 | Powell | 200/250 |
| 3,403,299 | A * | 9/1968 | Mrowka et al. | 361/634 |
| 3,404,315 | A * | 10/1968 | Jacobs et al. | 361/649 |
| 4,251,851 | A * | 2/1981 | Diersing et al. | 361/652 |
| 4,428,092 | A * | 1/1984 | Lipari | 15/246 |
| 4,993,100 | A * | 2/1991 | Halboth et al. | 15/118 |
| 5,144,775 | A * | 9/1992 | Bakanowsky, III | 451/558 |
| 6,086,388 | A * | 7/2000 | Sloey et al. | 439/110 |
| 6,213,861 | B1 * | 4/2001 | Gunn | 451/557 |
| 6,226,174 | B1 * | 5/2001 | Pratt | 361/600 |
| 6,416,702 | B1 * | 7/2002 | Montague et al. | 264/250 |
| 7,675,739 | B2 * | 3/2010 | Ewing et al. | 361/623 |

(Continued)

*Primary Examiner* — Monica Carter
*Assistant Examiner* — Marcel Dion
(74) *Attorney, Agent, or Firm* — Eckert Seamans Cherin & Mellott, LLC; John P. Powers; Grant E. Coffield

(57) ABSTRACT

A device for removing contaminants from a bus stab of an electrical enclosure is provided. The electrical enclosure includes an electrical bus member disposed in a first plane. The bus stab extends outwardly from the electrical bus member and is disposed in a second plane perpendicular to the first plane. The device includes a gripping assembly and a scraping assembly coupled thereto, the scraping assembly comprising a number of flexible members structured to scrape and thereby clean the bus stab, the device being structured to move in a direction parallel to the second plane when the flexible members scrape the bus stab.

20 Claims, 6 Drawing Sheets

(56) References Cited

U.S. PATENT DOCUMENTS

| | | | | |
|---|---|---|---|---|
| 7,767,905 | B2 * | 8/2010 | Meyer | 174/60 |
| 7,957,122 | B2 * | 6/2011 | Sharp | 361/673 |
| 9,059,553 | B2 * | 6/2015 | Vinci et al. | |
| 2010/0254074 | A1 * | 10/2010 | Rezac | 361/624 |
| 2011/0290278 | A1 * | 12/2011 | Swayne | 134/6 |
| 2012/0229958 | A1 * | 9/2012 | Hughes | 361/673 |

* cited by examiner

DECONTAMINATION DEVICE AND METHOD FOR REMOVING CONTAMINANTS FROM ELECTRICAL APPARATUS

BACKGROUND

1. Field

The disclosed concept pertains generally to electrical apparatus and more particularly, to decontamination devices for electrical apparatus. The disclosed concept also pertains to methods for removing contaminants from electrical apparatus.

2. Background Information

Electrical apparatus, such as electrical switching apparatus or electrical meters used in power distribution systems, are often mounted on or within an electrical enclosure (e.g., without limitation, a panelboard; a load center; a meter breaker panel) either individually or in combination with other electrical meters or switchgear (e.g., without limitation, circuit switching devices and circuit interrupters such as circuit breakers, contactors, motor starters, motor controllers and other load controllers).

The electrical enclosure is typically coupled to and supported by a structure such as, for example, a wall of a building, and includes a number of electrical bus members. Residential load centers, for example, include a number of electrical bus members having a plurality of bus stabs extending outwardly therefrom. Typically, a plurality of circuit breakers or other suitable electrical apparatus are mechanically coupled and electrically connected to the bus stabs and, in turn, to the electrical bus members within the electrical enclosure.

It is advantageous to have a clean electrical connection between the electrical apparatus and the bus stabs. Contaminants such as oxidation, and paint and dry wall dust from the building, often adhere to the bus stabs. During use, such contaminants can cause the bus stabs to overheat and burn.

There is room for improvement in decontamination devices and methods for removing contaminants from electrical apparatus.

SUMMARY

These needs and others are met by the disclosed concept, which is directed to an improved decontamination device that includes a number of flexible members for scraping a bus stab, which allows for a clean electrical connection between electrical apparatus and the bus stab.

In accordance with one aspect of the disclosed concept, a device is provided for removing contaminants from a bus stab of an electrical enclosure. The electrical enclosure includes an electrical bus member disposed in a first plane. The bus stab extends outwardly from the electrical bus member and is disposed in a second plane perpendicular to the first plane. The device includes a gripping assembly and a scraping assembly coupled thereto, the scraping assembly comprising a number of flexible members structured to scrape and thereby clean the bus stab, the device being structured to move in a direction parallel to the second plane when the flexible members scrape the bus stab.

As another aspect of the disclosed concept, a method is provided for removing contaminants from a bus stab within an electrical enclosure. The electrical enclosure includes a back pan and an electrical bus member, the electrical bus member being disposed in a first plane, the bus stab extending outwardly from the electrical bus member and being disposed in a second plane perpendicular to the first plane, the back pan having a tang. The method includes the steps of: providing a device, the device comprising a gripping assembly and a scraping assembly coupled thereto, the gripping assembly having a groove, the scraping assembly comprising a number of flexible members; coupling the device to the back pan, such that the tang is disposed in the groove; rotating the device onto the bus stab in a first direction parallel to the second plane to scrape the bus stab with the flexible members of the scraping assembly; and rotating the device in a second direction parallel to the second plane but opposite the first direction, to further scrape and thereby remove said contaminants from said bus stab.

BRIEF DESCRIPTION OF THE DRAWINGS

A full understanding of the disclosed concept can be gained from the following description of the preferred embodiments when read in conjunction with the accompanying drawings in which.

DESCRIPTION OF THE PREFERRED EMBODIMENTS

As employed herein, the term "electrical bus member" refers to any known or suitable electrical conductor which carries or transfers voltage, current or power.

As employed herein, the term "bus stab" refers to a portion of the electrical bus member to which a corresponding electrical apparatus (e.g., without limitation, an electrical switching apparatus; an electrical meter) is electrically connected.

As employed herein, the statement that two or more parts are "coupled" together shall mean that the parts are joined together either directly or joined through one or more intermediate parts.

As employed herein, the statement that two or more parts or components "engage" one another shall mean that the parts touch and/or exert a force against one another either directly or through one or more intermediate parts or components.

As employed herein, the term "number" shall mean one or an integer greater than one (i.e., a plurality).

As employed herein, the term "plane" shall mean an unbounded two dimensional area spanned by two linearly independent vectors.

Figure 1:
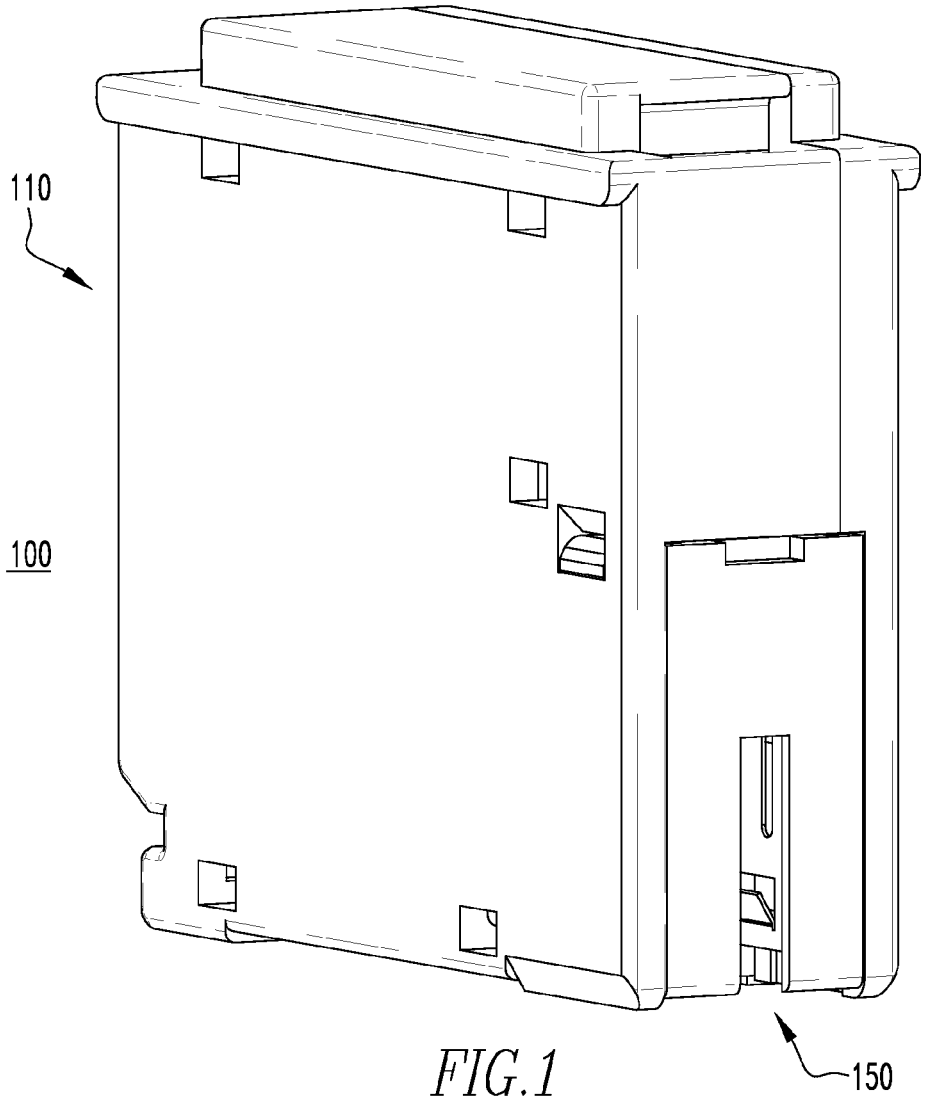
FIG. 1 is an isometric view of a decontamination device, in accordance with an embodiment of the disclosed concept.
Figure 2:
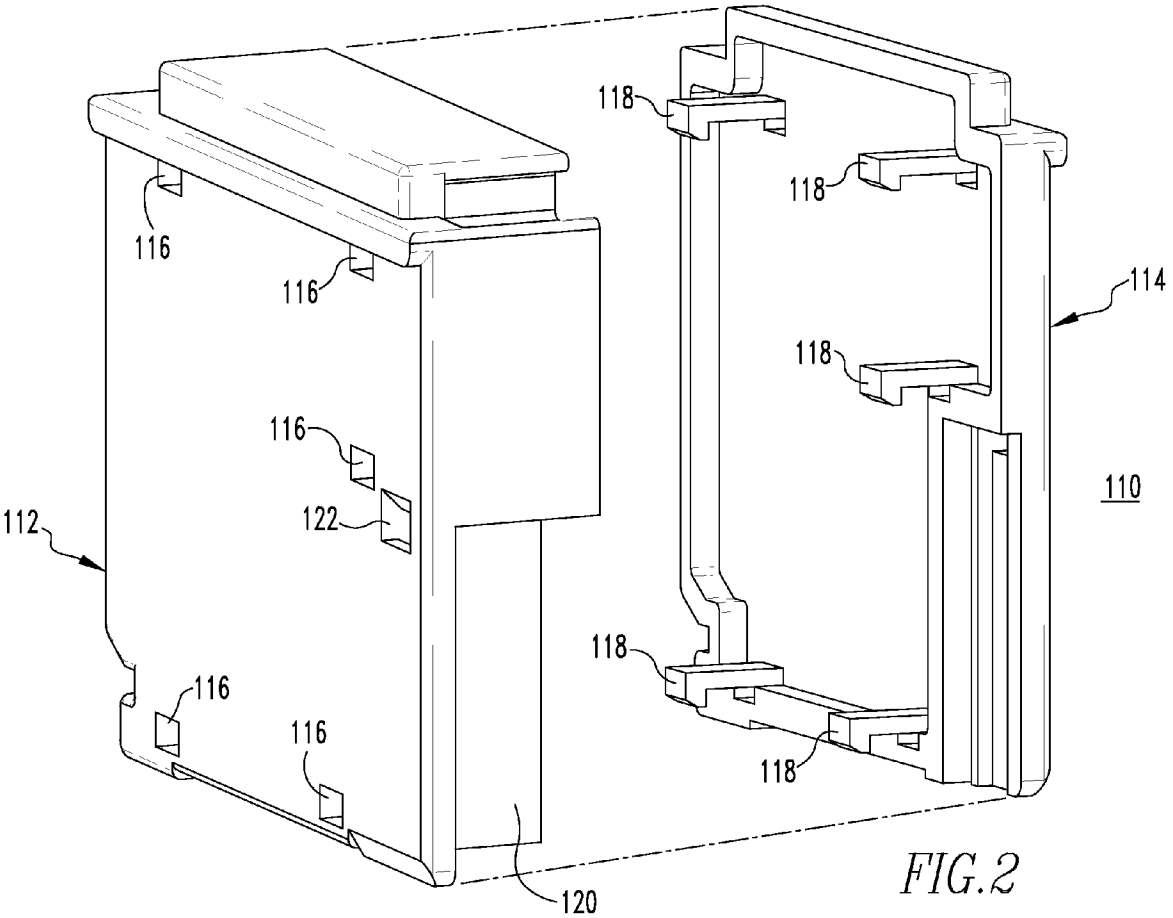
FIG. 2 is an exploded isometric view of a gripping assembly of the decontamination device of FIG. 1.
Figure 6:
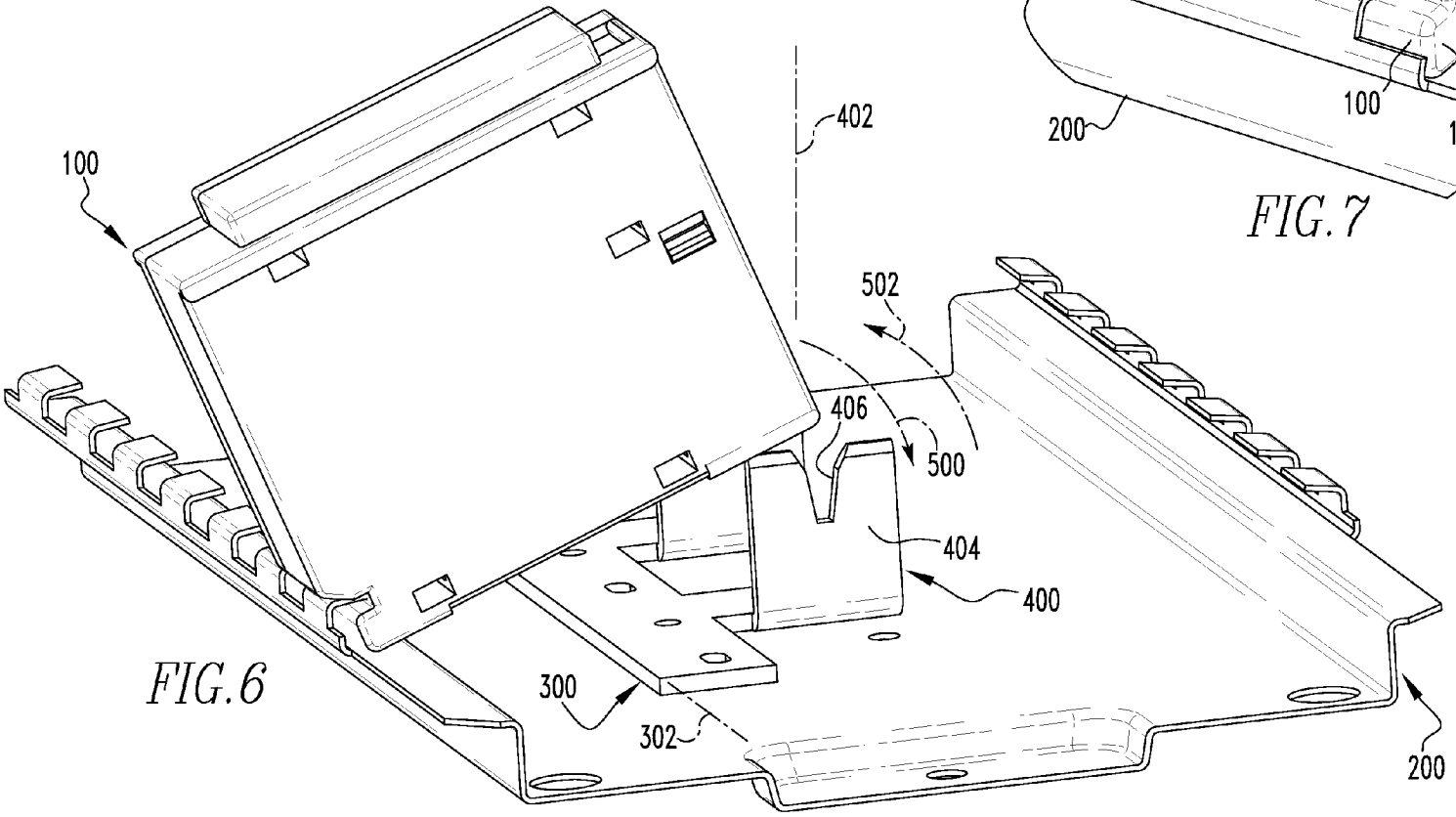
FIG. 6 is an isometric view of the decontamination device of FIG. 1, shown as employed on an electrical enclosure in accordance with an embodiment of the disclosed concept.
Figure 8:
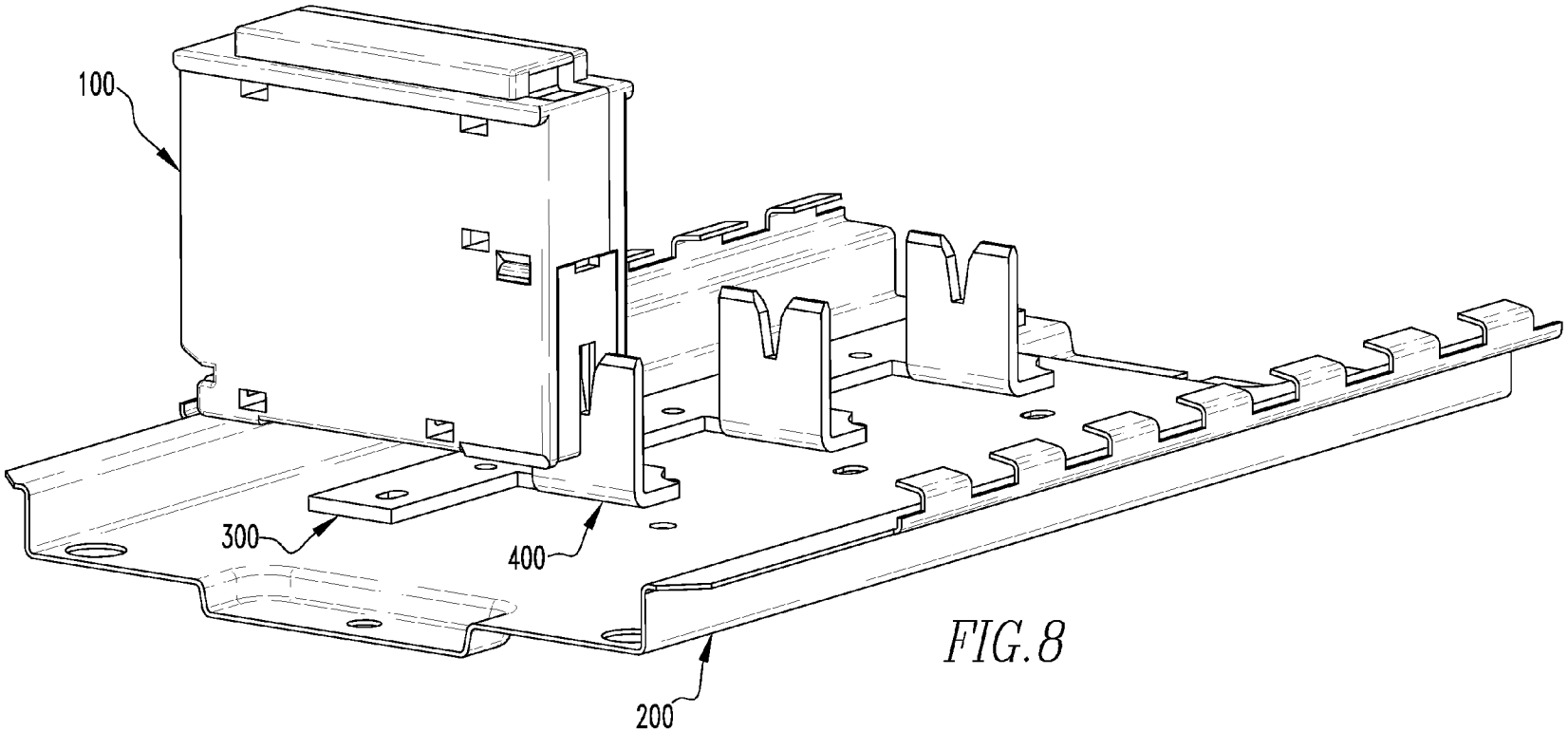
FIG. 8 is another isometric view of the decontamination device and electrical enclosure of FIG. 6.

FIG. 1 shows a decontamination device 100 for removing contaminants from a bus stab (see, for example and without limitation, bus stab 400 shown in FIGS. 6 and 8). The device 100 includes a gripping assembly 110 for a user to hold and a scraping assembly 150 for scraping the bus stab 400. The gripping assembly 110 is coupled to the scraping assembly 150 and as seen in FIG. 2, includes a housing 112 and a base 114. The housing 112 and the base 114 are constructed of a material containing a monomer, a polymer, or a mixture of a monomer and a polymer, preferably being constructed of a thermoplastic. In the event that electricity is still flowing in an electrical bus member (see, for example and without limitation, electrical bus member 300 shown in FIGS. 6 and 8), the material of the gripping assembly 110 advantageously protects a user by stopping the current from flowing through the device 100 when the device 100 engages the bus stab 400.

Figure 3:
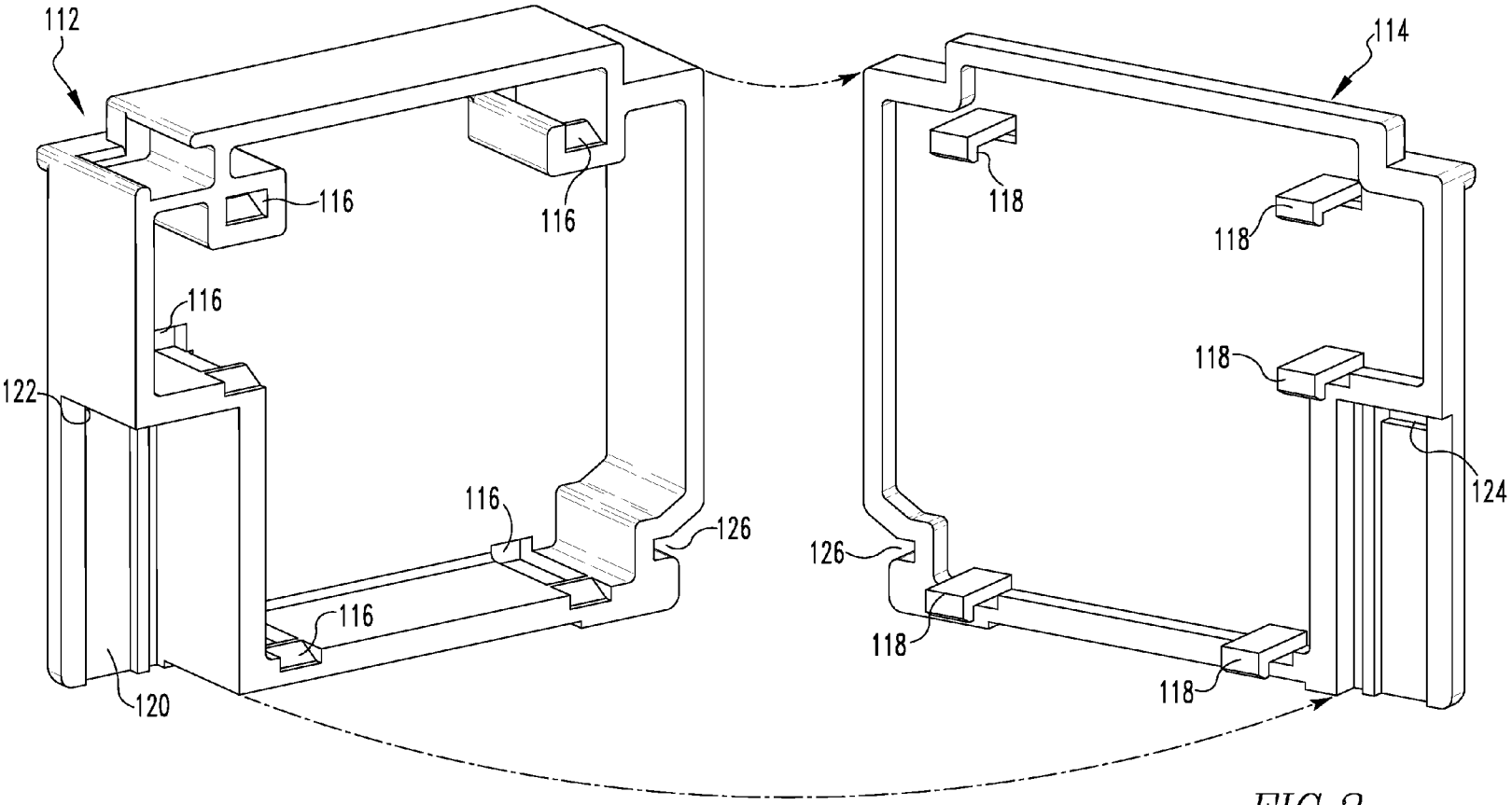
FIG. 3 is another exploded isometric view of the gripping assembly of the decontamination device of FIG. 1.

The housing 112 is preferably structured to be removably coupled to the base 114 by a suitable snap-fit mechanism. For example and without limitation, the housing 112 shown and described herein includes a number of openings 116 and the base 114 includes a number of tongues 118 that are structured to be located in the openings 116 when the housing 112 is coupled to the base 114. The example snap-fit assembly includes five openings 116 for receiving five corresponding tongues 118, as best shown in FIG. 3. It will be appreciated, however, that any other known or suitable number and/or configuration of suitable snap-fit mechanism could be employed.

Figure 4:
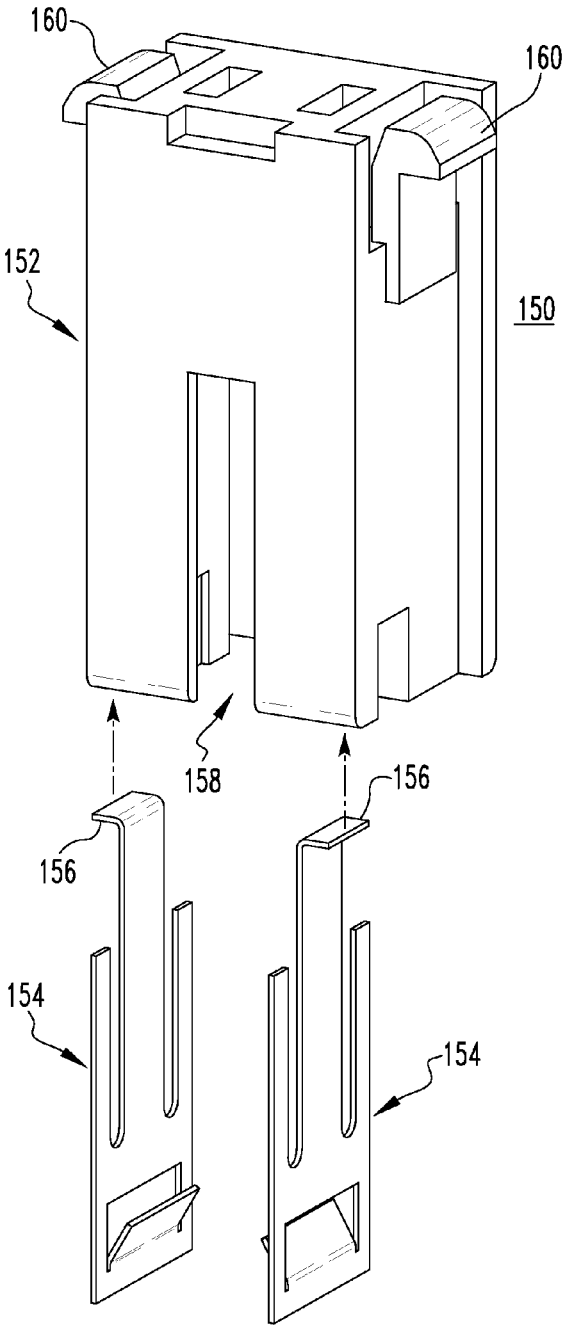
FIG. 4 is an exploded isometric view of a scraping assembly of the decontamination device of FIG. 1.

The housing 112 further includes an internal portion 120 and the scraping assembly 150 is structured to be located in the internal portion 120. Referring to FIG. 3, the housing 112 includes an opening 122 and the base 114 includes an opening 124. FIG. 4 shows an exploded isometric view of the scraping assembly 150, which includes a support member 152 and a pair of flexible members 154 structured to scrape and clean the bus stab 400. The support member 152 includes a pair of tongues 160 that are structured to be located in the openings 122,124 of the housing 112 and the base 114, respectively.

In this manner, the support member 152 is structured to be removably coupled to the internal portion 120 of the housing 112. Although the flexible members 154 wear down from repeated use, maintenance time can advantageously be reduced because the entire scraping assembly 150 can easily be removed and replaced. The disclosed concept has been described in association with the support member 152 that includes the pair of tongues 160 structured to couple the support member 152 to the internal portion 120 of the housing 112. However, it is within the scope of the disclosed concept for a support member (not shown) to have any suitable alternative number of tongues or to be coupled to a housing (not shown) by suitable alternative mechanisms (e.g., without limitation, a threaded coupling).

Furthermore, the support member 152, like the aforementioned housing 112 and base 114, is constructed of a material containing a monomer, a polymer, or a mixture of a monomer and a polymer, preferably being constructed of a thermoplastic. In the event that electricity is still flowing, the material of the support member 152, like the material of the housing 112 and the base 114, advantageously protects a user by stopping current from flowing through the device 100 and into a user when the device 100 engages the bus stab 400.

The flexible members 154 can be constructed of any material suitable for scraping (e.g., without limitation, emery cloth, brass, or brass coated with sandpaper, preferably being constructed of a material containing brass). Additionally, an entirely new scraping assembly (not shown) containing flexible members (not shown) constructed of different materials can easily replace the scraping assembly 150 to scrape and clean the bus stab 400. This allows the device 100 to clean different types and degrees of contamination of the bus stab 400 with greater ease.

Furthermore, the flexible members 154 each include a tongue 156 that is structured to be located in a corresponding groove (not shown) of an internal portion 158 of the support member 152. In this manner, the flexible members 154 are structured to be removably coupled to the internal portion 158 of the support member 152. Continuing to refer to FIG. 4, the disclosed concept is not limited to two flexible members 154. For example and without limitation, it is within the scope of the disclosed concept to have more than two flexible members (not shown) or to have one unitary flexible member (not shown) structured to scrape the bus stab 400.

Figure 5A:
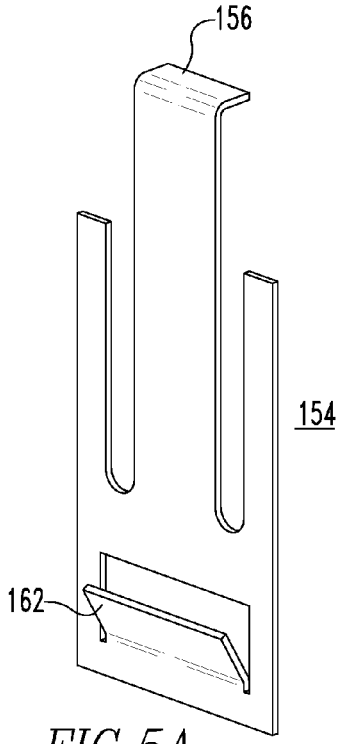
FIG. 5A is an isometric view of a portion of the scraping assembly of FIG. 4.
Figure 5B:
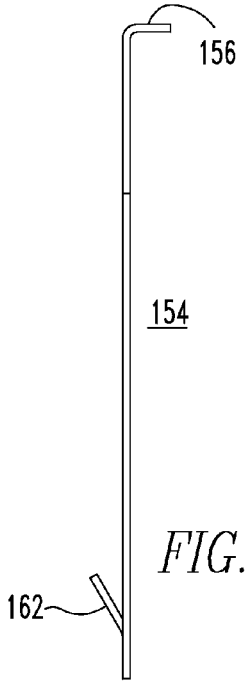
FIG. 5B is a side elevation view of the portion of FIG. 5A.

FIGS. 5A and 5B show one of the flexible members 154. As seen, the flexible member 154 includes a scraping component 162. In operation, the scraping component 162 is structured to scrape and clean the bus stab 400. Referring to FIG. 6, the device 100 is structured to be coupled to a back pan 200 of an electrical enclosure (partially shown in FIGS. 6 and 8). As seen, the electrical enclosure further includes the electrical bus member 300 and the bus stab 400 that extends outwardly from the electrical bus member 300. The electrical bus member 300 is located in a plane 302 and the bus stab 400 is located in another plane 402 perpendicular to the plane 302.

Figure 7:
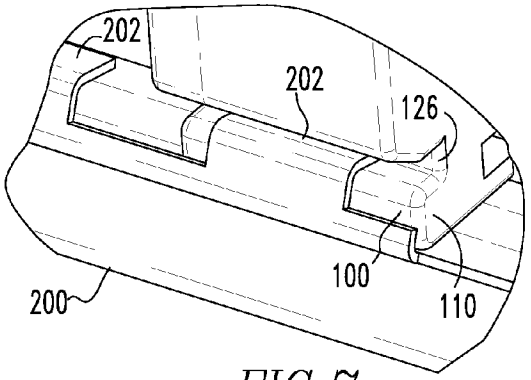
FIG. 7 is an enlarged isometric view of a portion of FIG. 6.

Referring to FIG. 7, the gripping assembly 110 includes a groove 126 and the back pan 200 includes a tang 202 that is structured to be located in the groove 126. As seen in FIG. 6, the device 100 is structured to rotate in a direction 500 that is parallel to the plane 402. As the device 100 rotates in the direction 500, the scraping components 162 of the flexible members 154 scrape the bus stab 400 on a first side 404 and a second side 406. FIG. 8 shows the device 100 fully rotated and located on the bus stab 400. After the device 100 is rotated onto the bus stab 400, the device is structured to rotate in a direction 502 to further scrape the bus stab 400. The direction 502 is parallel to the plane 402, but opposite the direction 500.

As the device 100 rotates on and off the bus stab 400, contaminants, such as oxidation, and paint and dry wall dust, are removed from the bus stab 400, advantageously allowing for a clean connection between electrical apparatus (e.g., without limitation, a circuit breaker) and the bus stab 400. Additionally, although the disclosed concept has been described in association with the bus stab 400, it is within the scope of the disclosed concept for a device (not shown) to be structured to scrape a bus stab (not shown) with an alternative shape (e.g., without limitation, a cylindrical shape).

Furthermore, the gripping assembly 110 is structured to have a footprint that is substantially similar to a circuit breaker (not shown). As a result, the location where the device 100 engages and scrapes the bus stab 400 will be approximately the same as the location where electrical apparatus (not shown) (e.g., without limitation, a circuit breaker) engage the bus stab 400. This further allows for a clean connection between electrical apparatus and the bus stab 400.

The foregoing description of the invention has been presented for purposes of illustration and description. It is not intended to be exhaustive or to limit the invention to the precise form disclosed, and other modifications and variations may be possible in light of the above teachings. The embodiment was chosen and described in order to best explain the principles of the invention and its practical application to thereby enable others skilled in the art to best utilize the invention in various embodiments and various modifications as are suited to the particular use contemplated. It is intended that the appended claims be construed to include other alternative embodiments of the invention except insofar as limited by the prior art.

What is claimed is:

1. A device for removing contaminants from a bus stab of an electrical enclosure, the electrical enclosure comprising an electrical bus member disposed in a first plane, the bus stab extending outwardly from the electrical bus member and being disposed in a second plane perpendicular to the first plane, the device comprising:

a gripping assembly and a scraping assembly coupled thereto, the scraping assembly comprising a number of flexible members structured to scrape and thereby clean the bus stab, the device being structured to move in a direction parallel to the second plane when the flexible members scrape the bus stab, wherein the gripping assembly comprises a housing including a groove disposed generally opposite the scraping assembly;

wherein the groove engages a portion of the electrical enclosure;

wherein the device rotates about the groove to pivot the scraping assembly into and out of engagement with the bus stab, thereby scraping and cleaning the bus stab;

wherein the bus stab has a first side and a second side;

wherein the scraping assembly further comprises a support member;

wherein the support member comprises an internal portion;

wherein the number of flexible members are two flexible members coupled to the internal portion of the support member;

wherein the two flexible members are structured to scrape the bus stab on the first side of the bus stab and the second side of the bus stab;

wherein the two flexible members are removably coupled to the internal portion of the support member and are substantially enclosed thereby;

wherein the gripping assembly further comprises a base coupled to the housing; wherein the housing comprises an internal portion; and wherein the support member is removably coupled to the internal portion of the housing.

2. The device of claim 1 wherein the base is removably coupled to the housing.

3. The device of claim 2 wherein the base is removably coupled to the housing by a snap-fit mechanism.

4. The device of claim 1 wherein the two flexible members are constructed of a material selected from the group consisting of emery cloth, brass, and brass coated with sandpaper.

5. The device of claim 1 wherein each of the base, the housing, and the support member is constructed of a material containing a monomer, polymer, or mixture of a monomer and a polymer.

6. The device of claim 5 wherein the base, the housing, and the support member are all constructed of a thermoplastic.

7. The device of claim 1 wherein the gripping assembly has a footprint; and wherein the footprint is structured to be substantially similar to a circuit breaker.

8. The device of claim 1 wherein each of the flexible members comprises a body portion, a tongue, and a scraping component; wherein the body portion is elongated and comprises a first distal end and a second distal end disposed opposite and distal the first distal end; wherein the tongue extends outwardly from the first distal end; and wherein the scraping component extends outwardly from the body portion proximate the second distal end.

9. The device of claim 8 wherein the flexible members are a first flexible member and a second flexible member; wherein the tongue of the first flexible member extends outwardly from the first distal end of the first flexible member in a first direction; and wherein the tongue of the second flexible member extends outwardly from the first distal end of the second flexible member in a second direction opposite the first direction.

10. The device of claim 8 wherein the flexible members are a first flexible member and a second flexible member; and wherein the body portion of the first flexible member is disposed parallel to the body portion of the second flexible member.

11. A method for removing contaminants from a bus stab within an electrical enclosure, the electrical enclosure comprising a back pan and an electrical bus member, the electrical bus member being disposed in a first plane, the bus stab extending outwardly from the electrical bus member and being disposed in a second plane perpendicular to the first plane, the back pan having a tang, the method comprising the steps of:

providing a device, the device comprising a gripping assembly and a scraping assembly coupled thereto, the gripping assembly having a groove, the scraping assembly comprising a support member and a number of flexible members coupled to an internal portion of the support member;

coupling the device to the back pan, such that the tang is disposed in the groove;

rotating the device onto the bus stab in a first direction parallel to the second plane to scrape the bus stab with the flexible members of the scraping assembly; and rotating the device in a second direction parallel to the second plane but opposite the first direction, to further scrape and thereby remove said contaminants from said bus stab;

wherein the support member is constructed of a material containing a monomer, polymer, or mixture of a monomer and a polymer;

wherein the bus stab has a first side and a second side;

wherein the number of flexible members are two flexible members coupled to the internal portion of the support member;

wherein the two flexible members are structured to scrape the bus stab on the first side of the bus stab and the second side of the bus stab;

wherein the two flexible members are removably coupled to the internal portion of the support member;

wherein the gripping assembly comprises a base and a housing coupled to the base; wherein the housing comprises an internal portion; and wherein the support member is removably coupled to the internal portion of the housing.

12. The method of claim 11 wherein the housing is removably coupled to the base.

13. The method of claim 12 wherein the housing is removably coupled to the base by a snap-fit mechanism.

14. The method of claim 11 wherein the two flexible members are constructed of a material selected from the group consisting of emery cloth, brass, and brass coated with sandpaper.

15. The method of claim 11 wherein the gripping assembly has a footprint; and wherein the footprint is structured to be substantially similar to a circuit breaker.

16. The method of claim 11 wherein each of the flexible members comprises a body portion, a tongue, and a scraping component; wherein the body portion is elongated and comprises a first distal end and a second distal end disposed opposite and distal the first distal end; wherein the tongue extends outwardly from the first distal end; and wherein the scraping component extends outwardly from the body portion proximate the second distal end.

17. The method of claim 16 wherein the flexible members are a first flexible member and a second flexible member; wherein the tongue of the first flexible member extends outwardly from the first distal end of the first flexible member in a first direction; and wherein the tongue of the second flexible member extends outwardly from the first distal end of the second flexible member in a second direction opposite the first direction.

18. The method of claim 16 wherein the flexible members are a first flexible member and a second flexible member; and wherein the body portion of the first flexible member is disposed parallel to the body portion of the second flexible member.

19. A method for removing contaminants from a bus stab within an electrical enclosure, the electrical enclosure comprising a back pan and an electrical bus member, the electrical bus member being disposed in a first plane, the bus stab extending outwardly from the electrical bus member and being disposed in a second plane perpendicular to the first plane, the back pan having a tang, the method comprising the steps of:

providing a device, the device comprising a gripping assembly and a scraping assembly coupled thereto, the gripping assembly having a groove, the scraping assembly comprising a number of flexible members;

coupling the device to the back pan, such that the tang is disposed in the groove;

rotating the device onto the bus stab in a first direction parallel to the second plane to scrape the bus stab with the flexible members of the scraping assembly; and rotating the device in a second direction parallel to the second plane but opposite the first direction, to further scrape and thereby remove said contaminants from said bus stab;

wherein the bus stab has a first side and a second side, wherein the scraping assembly further comprises a support member, wherein the support member comprises an internal portion, wherein the number of flexible members are two flexible members coupled to the internal portion of the support member, wherein the two flexible members are structured to scrape the bus stab on the first side of the bus stab and the second side of the bus stab, wherein the two flexible members are removably coupled to the internal portion of the support member, wherein the gripping assembly comprises a base and a housing coupled to the base, wherein the housing comprises an internal portion, wherein the support member is removably coupled to the internal portion of the housing, and wherein each of the base, the housing, and the support member is constructed of a material containing a monomer, polymer, or mixture of a monomer and a polymer.

20. The method of claim 19 wherein the base, the housing, and the support member are all constructed of a thermoplastic.

* * * * *